United States Patent [19]

White et al.

[11] 4,266,602

[45] May 12, 1981

[54] HEAT EXCHANGER FOR COOLING ELECTRICAL POWER APPARATUS

[75] Inventors: Dale White, Muncie; David L. Ayers, West Lafayette, both of Ind.; Allan E. Hribar, Churchill Borough, Pa.

[73] Assignee: Westinghouse Electric Corp., Pittsburgh, Pa.

[21] Appl. No.: 122,937

[22] Filed: Feb. 21, 1980

[51] Int. Cl.[3] ..... F28F 9/22

[52] U.S. Cl. ..... 165/124; 165/135; 181/224

[58] Field of Search ..... 165/127, 126, 124, 122, 165/135; 181/224, 225

[56] References Cited

U.S. PATENT DOCUMENTS

| | | | |
|---|---|---|---|
| 2,176,319 | 10/1939 | Anderson | 181/224 X |
| 2,242,337 | 5/1941 | Aufiero | 165/127 |
| 2,270,825 | 1/1942 | Parkinson et al. | 181/224 |
| 2,584,442 | 2/1952 | Frie | 165/126 |
| 3,033,307 | 5/1962 | Sanders et al. | 181/224 |
| 3,434,530 | 3/1969 | Davis | 165/122 |
| 3,841,434 | 10/1974 | Culpepper, Jr. | 181/224 |

FOREIGN PATENT DOCUMENTS

| | | | |
|---|---|---|---|
| 970272 | 7/1975 | Canada | 165/122 |
| 1475284 | 3/1967 | France | 165/122 |
| 2385064 | 11/1978 | France | 165/122 |

OTHER PUBLICATIONS

Air-Cooling Scheme Having Enhanced Acoustic Performance, Chu, IBM Technical Disclosure Bulletin, vol. 22, No. 3, pp. 1108-1110, Aug. 1979.

*Primary Examiner*—Sheldon J. Richter
*Attorney, Agent, or Firm*—D. R. Lackey

[57] ABSTRACT

Fluid-to-air heat exchanger apparatus which maximizes heat dissipation capacity for a given base size, while reducing operating sound level. The components of the heat exchanger are vertically located in a vertically elongated housing, with the tube core and fans centrally disposed therein. Sound attenuating muffler sections are disposed above and below the tube core and fans, with the air entering and leaving the housing adjacent to the bottom and top portions thereof, respectively.

25 Claims, 5 Drawing Figures

HEAT EXCHANGER FOR COOLING ELECTRICAL POWER APPARATUS

BACKGROUND OF THE INVENTION

1. Field of the Invention:

The invention relates in general to heat exchangers or coolers, and more specifically to cooling fluid-to-air heat exchangers suitable for cooling electrical power apparatus, such as the power transformers used by electrical utilities.

2. Description of the Prior Art:

Over the past decade there has been an increased public awareness that noise is not an inevitable result of of technological society and that it can be annoying. This increased awareness has resulted in enactment of a great variety of local noise control laws. The relatively low noise emissions permitted by these laws are requirements which must be met by the electric utilities.

The noise emissions of electrical power transformers are of considerable concern to utilities because transformers are often located in or near residential areas. The sound of the transformer itself can be attenuated by building sound barriers on one or more sides of the transformer. This method of noise control has been used for many years. The transformer cooling, however, must be located outside of these sound barriers so that there is free air flow through the coolers.

There are a number of different types of coolers than can be supplied with a transformer but for substation transformers only two are in general use. The first of these is made of either wide plate fins or flattened tubes that can provide thermosiphon cooling or pumped oil and/or forced air cooling. These coolers are usually referred to as either radiators or tube coolers.

The second type of cooler usually is made of closely packed finned tubes. The oil is always pumped through the tubes and air is always blown across the tubes. This is commonly called and FOA cooler. This type of cooler has very little thermosiphon capacity.

The primary sources of noise from any cooler are the fans, so the use of thermosiphon cooling seems the correct choice when a low noise level is required. Thermosiphon coolers, however, are very large when compared with an FOA cooler. Further, the heat transfer inside the transformer is not as efficient, and to correct this an increase in the size of the transformer itself is required. Use of thermosiphon coolers where transformers must meet low sound level restrictions is generally ruled against by economic considerations, because land costs are at a premium in such locations and increasing the size of the installation is simply not feasible.

On the other hand, FOA coolers, while requiring much less space and providing more efficient heat transfer inside the transformer coils, generate high noise levels because of the large air flow requirements that must be provided by fans.

Existing FOA transformer oil coolers have sound levels in excess of 70 dBA. Because this type of cooler seems otherwise best suited to locations where this sound level is not permitted, it would be desirable to provide a new and improved FOA cooler with low noise emissions.

SUMMARY OF THE INVENTION

Briefly, the present invention is a new and improved fluid-to-air heat exchanger or cooler suitable for cooling the fluid in electrical power apparatus, such as oil or $SF_6$ cooled electrical power transformers. The new and improved heat exchanger provides a large heat dissipation capacity in a small floor space or area, while generating substantially less noise than prior art coolers of comparable rating. This is accomplished by a vertical mounting arrangement of the components which include sound dissipative mufflers disposed above and below a centrally located tube core and air moving system. In a preferred embodiment, the tube core is vertically divided into upper and lower portions, and two fans operating in parallel are located in the resulting space between the upper and lower sections to further reduce radiated fan noise. Each portion or section of the tube core is bent to provide a V, or an inverted V configuration, to increase tube length without adding to the cooler base area, and without adding significantly to the overall height of the cooler. The fan plane is also bent into a V configuration, such that each of the fans is mounted on an inclined fan plane, with the two fan planes intersecting one another to provide a predetermined obtuse angle therebetween. The V configurations of the upper and lower portions of the tube core and fan plane are similarly oriented and nested to reduce the height dimension of this assembly. The various components of the heat exchanger are mounted in a vertically elongated housing having acoustic treatment on the walls thereof, and about the air openings near the bottom and top portions of the housing. Air is drawn into the housing through the lower openings perpendicular to the vertical axis of the housing via curved, acoustically lined 90° bends, and the air is then directed vertically upward through the lower muffler, the tube core, and upper muffler. The air is then ejected from the housing horizontally through the upper openings via curved acoustically lined 90° bends. The tube core is adapted for fluid flow communication with the fluid in the electrical power apparatus to be cooled, via a pump which may be disposed in an acoustically isolated compartment in the housing, such as in the bottom portion of the housing.

BRIEF DESCRIPTION OF THE DRAWINGS

The invention may be better understood, and further advantages and uses thereof more readily apparent when considered in view of the following detailed description of exemplary embodiments, taken with the accompanying drawings, in which.

DESCRIPTION OF PREFERRED EMBODIMENTS

Figure 1:
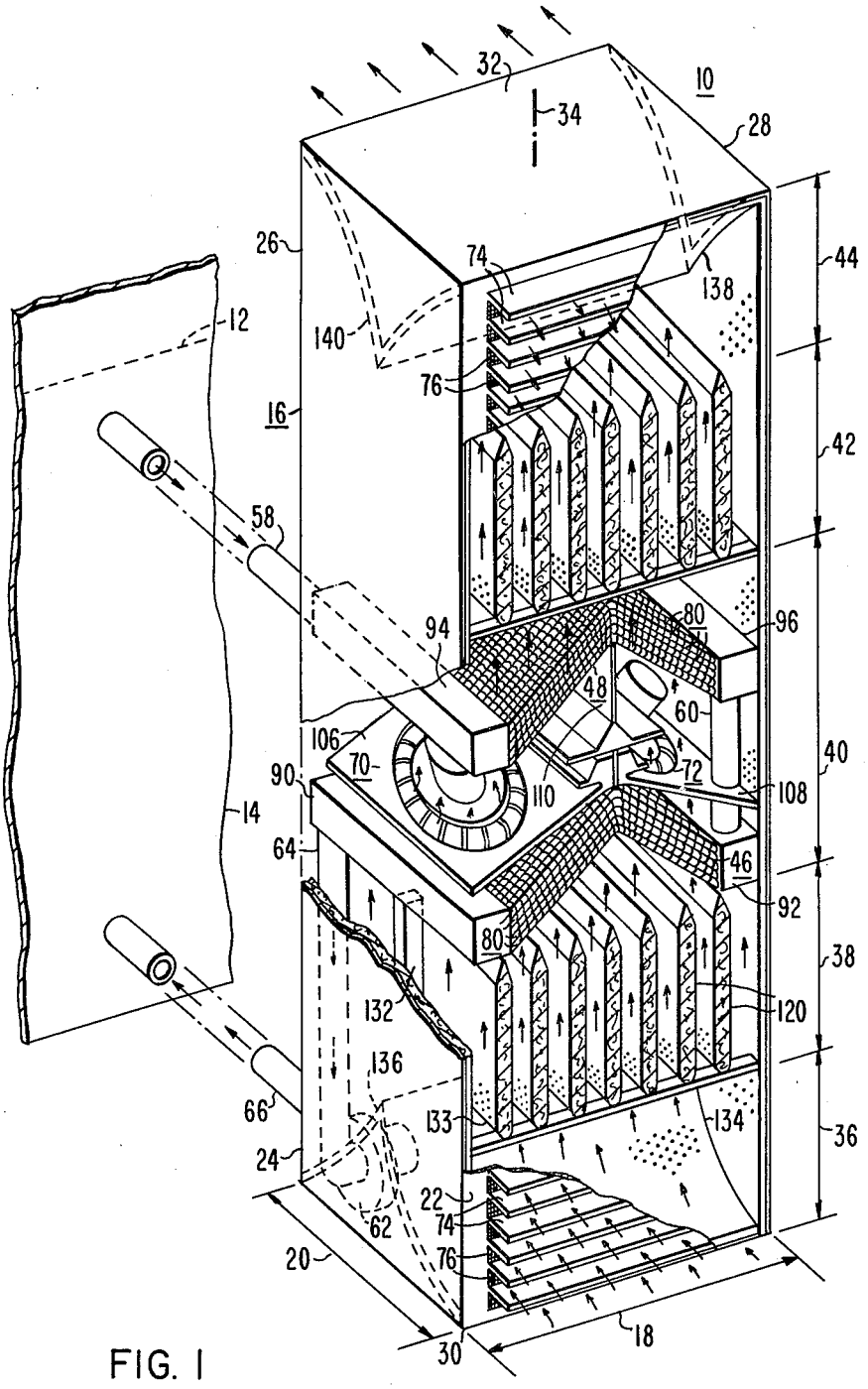
FIG. 1 is a partially cut away perspective view of a heat exchanger for cooling electrical power apparatus, with the heat exchanger being constructed according to the teachings of the invention.

Referring now to the drawings, and to FIG. 1 in particular, there is shown a new and improved fluid-to-air heat exchanger or cooler 10 suitable for cooling the fluid 12 in large electrical power apparatus 14, such as the power transformers used by an electrical utility. The fluid 12 may be a liquid, such as oil, a gas such as $SF_6$, or any other suitable liquid or gas. In general, cooler 10 is an FOA cooler in which the fluid 12, such as electrical grade mineral oil, is continuously circulated by a pump through a heat exchanger tube core, with electrical fans continuously causing air flow over the tube core. The objective is to provide a predetermined heat dissipation capacity within a certain limited rectangularly shaped area, with a substantially lower noise level than similarly rated prior art FOA coolers. For purposes of example, cooler 10 will be described as having a heat dissipation capacity of 200 kw with a 40° C. ambient, a fluid inlet temperature of 55° C., a base area not to exceed five feet by seven feet, and with a sound level not to exceed 57 dBA measured six feet away from any of the sides or top of the cooler. Certain of the constructional details will change when the constraints are changed, but the invention sets forth new and improved component arrangements which are applicable to any FOA cooler where maximum heat dissipation capacity and low sound levels are required for a given base area of the cooler.

The construction of a low sound level FOA cooler is complicated by the interactions which occur between the various components of the cooler. For example, the pressure drop through sound dissipative portions increases as the attenuation of the sound dissipative portions is increased. This increased pressure drop requires that the air movers be designed for greater pressure. This, in turn, increases air mover source noise. Additional interactions of the design parameters are present for the heat exchanger portion and the air movers. All of these interactions are coordinated in the present cooler 10 to provide an optimum overall arrangement which meets all required specifications. The present invention selects a basic configuration which allows maximum freedom in varying other cooler parameters.

In general, placement of the subsystems or internal components of the cooler 10 is vertical to meet the area constraint, with the various components being mated in a manner to reduce overall cooler volume, minimize the source noise, and allow room for sufficient acoustic treatment to meet noise level requirements.

More specifically, cooler 10 includes a free standing housing 16 constructed for outdoor mounting on a suitable foundation through vibration isolators. Housing 16 has a rectangular configuration in horizontal cross-section which defines a dimension 18 on the long side of the rectangular, and a dimension 20 on the shorter side. As hereinbefore stated, the long dimension 18 is seven feet and the short dimension 20 is five feet, in the example to be described. A further constraint on the design of the specific example requires that the short sides of the cooler 10 be capable of placement against the short sides of like coolers, as one cooler 10 will usually provide only part of the cooling for a typical electrical power transformer. Thus, in the example, all air openings in the housing 16 are on the sides of the long dimension 18.

Thus, housing 16 includes first and second long sides 22 and 24, respectively, i.e., the sides which have the longer dimension 18, first and second shorter sides 26 and 28, respectively, a bottom portion 30, and a top portion 32. A longitudinal or vertical axis through the vertically elongated structure is indicated at 34. The housing is referred to as vertically elongated, as its height may reach about 22 feet in the specific example.

Cooler 10, starting at the bottom 30, includes the following vertically arranged main components. An air inlet section 36, a first or lower sound dissipative muffler section 38, a reactive chamber and heat exchanger portion 40, a second or upper sound dissipative muffler section 42 and an air exhaust 44.

Housing 16 is preferably constructed in the form of a free-standing framework (not shown) in which the sides 22, 24, 26, and 28 are formed by easily attached, and easily removed metallic side panels having acoustic treatment attached to the inner surfaces of the panels. This construction permits easy access to the major cooler components for maintenance. As hereinbefore stated, the freestanding framework is anchored to a foundation through vibration isolators.

Figure 2:
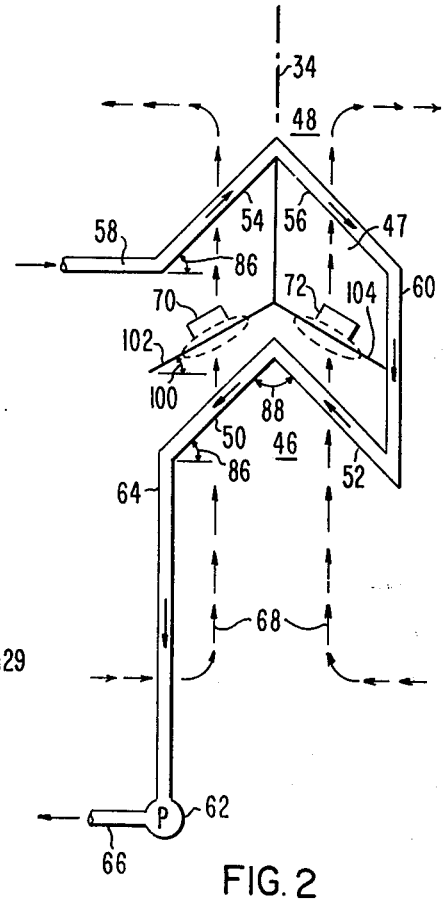
FIG. 2 is a diagram which illustrates the fluid and air flow through the heat exchanger shown in FIG. 1.

The basic configuration of cooler 10, from the standpoint of fluid and air flow is shown schematically in FIG. 2. In a preferred embodiment of the invention, the reactive chamber and heat exchanger portion 40 is divided into lower and upper portions 46 and 48, respectively, with each section being bent to define a V, or an inverted V configuration. The exemplary embodiment includes the inverted V configuration, but it is to be understood that the described configuration of the heat exchanger portion 40 is just as effective if turned upside down. A predetermined space 47 is provided between the lower and upper portions 46 and 48. The lower portion 46 includes first and second leg portions 50 and 52, respectively, and the upper portion 48 includes first and second leg portions 54 and 56, respectively. The fluid to be cooled, in a preferred embodiment, enters the upper heat exchanger portion 48 via inlet pipe 58. The fluid traverses the two legs 54 and 56 of portion 48 and continues to the lower heat exchanger portion 46 via conduit or pipe 60. The fluid then traverses legs 52 and 50 of portion 46 and it then flows to a pump 62 via pipe 64. The cooled fluid returns to the electrical apparatus 14 via an outlet pipe 66.

First and second axial fans 70 and 72 with air-foil blading-are disposed in the space 47 between the lower and upper heat exchanger portions 46 and 48. Fans 70 and 72 are disposed to operate in parallel, and to cause an air flow indicated by arrows 68. Air, flowing horizontally, is brought into housing 16 through inlet section 36 and directed upward through muffler 38, the reactive chamber and heat exchanger portion 40, and muffler 42. The air exits housing 16 through portion 44 with portion 44 changing the vertical air flow to horizontal flow. It is important to note the counter flow arrangement in FIG. 2, which is the preferred arrangement, wherein the liquid enters the upper heat exchanger 48 and flows downwardly to the lower heat exchanger 46, and the air enters the bottom of housing 16 and flows upwardly.

Pump 62 is preferably mounted within the enclosure 16, as it may then be easily surrounded by acoustic treatment. For ease of access, pump 62 is preferably mounted in the lower section 36. However, it may be mounted higher in the housing 16, between the inlet 58 and the upper heat exchanger 48, if desired.

The openings in sections 36 and 44 at the bottom and top of the cooler housing 16, respectively, are located on both of the longer sides 22 and 24. These air openings are shielded by downwardly sloped louvers 74, in order to prevent the entrance of rain. The openings are covered with hardware cloth 76, of similar suitable material, so that animals, birds, and debris cannot get inside.

Turning first to the reactive and heat exchanger portion 40 of the internal components, the tube core may be a single or undivided tube core with the fans mounted above, or below, the undivided tube core. However, in order to provide maximum sound attenuation, the tube core is preferably divided into lower and upper portions 46 and 48 in order to provide a space 47 for mounting fans 70 and 72. This arrangement provides the greatest sound isolation for the fans. Vertical division of the tube core is applicable any time the tube core includes four or more vertical layers of finned tubes. In addition to providing additional sound isolation for the fans, the vertical division of the tube core enables the preferred oil circuiting arrangement hereinbefore pointed out relative to FIG. 2.

Figure 3:
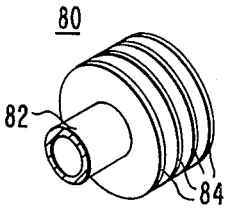
FIG. 3 is a perspective view of a finned tube used in the tube core of the heat exchanger shown in FIG. 1.

The upper and lower tube cores are constructed of a large plurality of tubes which have a plurality of fins, to enhance air-side heat conductance. FIG. 3 is a perspective view of a suitable finned tube 80 which may be used. Finned tube 80 includes a tube portion 82 and a plurality of fins 84 which are attached to the outside diameter of tube portion 82. The fins 84 may be spiral wrapped circular fins, or plate fins. The fins 82 increase air side surface area, but it is important that the fin density be within a predetermined range. In other words, fin density can be increased to a point where added fan noise benefit due to enhanced air-side conductance is offset by degradation due to increased pressure drop. Using 0.625 inch O.D. copper or aluminum tube having a wall thickness of 0.075 inch and a fin thickness of 0.012 inch, the fin density range should be about 8 to 14 per inch. Eleven fins per inch is preferred as a good compromise between air flow and pressure drop.

The finned tubes 80 are arranged in closely packed layers. If ten layers are required, for example, in the preferred embodiment of the invention five layers would be disposed in the lower portion 46, and five layers would be disposed in the upper portion 48.

In order to obtain maximum heat dissipation capacity, in a given base area, it is necessary to tilt the tube core portion to either enhance its width, or length. To provide this tilting without adding unnecessarily to the height of the heat exchanger section 40, the tube core is bent at its mid-point to provide a V shape having a predetermined orientation, such as the inverted V orientation shown in FIGS. 1 and 2, or an uninverted orientation. Tilting and bending the tube core such that it maximizes the length of the finned tubes, rather than the number of finned tubes per layer, is preferred. This arrangement provides minimum source noise because of improved oil side conductance.

For a heat dissipation capacity of 200 kv in a five foot by seven foot area, ten years of finned tubes are required, divided five and five between the lower and upper tube core sections 46 and 48, respectively. The longitudinal axes of the finned tubes in each layer are offset, from layer to layer, providing 38 finned tubes in the first, third, and fifth layers, and 37 finned tubes in the second and fourth layers. Selecting an angle of tilt, i.e. angle 86 in FIG. 2, in the range of 40° to 45°, such as 42°, and thus a bend angle 88 of 96° at the midpoints at the tubes, enables the finned tubes 80 to have a length of about 90 inches.

In addition to enabling the fans 70 and 72 to be buried between the upper and lower tubes cores 48 and 46, to provide additional sound isolation for the fans, the vertical splitting of the tube core enables advantageous fluid circuiting to enhance heat transfer from the fluid or oil to the air stream. This advantageous circuiting, in a preferred embodiment, is a completely parallel system in each core half, which maximizes fluid flow rate. A completely serial system, wherein the fluid flows through the tubes in series, produces the minimum flow rate. A series/parallel core system which requires two headers on the same side of the tube core, provides a flow rate between the completely parallel and completely serial systems. While the completely parallel system preferred by the invention has the lowest fluid velocity, it does provide adequate velocity and thus an adequate fluid side-convective heat transfer coefficient. Further, the preferred parallel arrangement enables the use of simple, horizontally spaced box headers to distribute and collect the fluid at opposite ends of the tube core. The series arrangement requires return bends at each end of the tube core, and the series/parallel arrangement requires return bends at one end of the tube core, and inlet and outlet oil headers at the other end.

More specifically, in the preferred completely parallel embodiment, the lower tube core 46 includes first and second box headers 90 and 92, respectively, and the upper tube core 48 includes first and second horizontally spaced box headers 94 and 96, respectively. In the exemplary embodiment, the finned tubes 80, arranged in a plurality of vertically nested layers, with a predetermined number of finned tubes 80 per layer, extend upwardly from the first header at the angle 86 from the horizontal until reaching the bend angle 88. The finned tubes then extend downwardly to the second header, at a like angle with the horizontal. The fluid inlet 58 is connected to the first header 94 of the upper tube core 48, receiving the fluid or oil 12 from the electrical apparatus 14. The fluid flows in parallel through the plurality of finned tubes 80 of the upper tube core to the second header 96, where it is collected. The collected fluid flows from the second header 96 of the upper tube core 48 to the second header 92 of the lower tube core 46 via suitable pipe means 60. The fluid then flows in parallel through the plurality of finned tubes 80 of the lower tube core to the first header 90, where it is collected and directed to the pump 62 via pipe means 64. The pump 62 returns the fluid to the electrical apparatus via the outlet pipe 66.

Fans 70 and 72 should be selected to provide about 10,000 CFM of air at about 0.4 to 0.5 inches of water head rise, in the exemplary embodiment. The fans should be axial fans direct-connected to electrical drive motors, with the motors being mounted via suitable vibration isolating mounts. If the two fans are placed in series, the allowable size becomes quite large so that while low flow velocity may be maintained, the blade pressure loading becomes very small. The required pressure rise for full-flow operation would be split between the two fans. This increases the specific speed, unless motor speeds less than 300 rpm are used. The end result is less efficiency and increased fan noise generation, assuming the use of practical available motors. Further, operation with one fan, when the other of the fans fails, must be considered. Single fan operation for two fans operating in series causes severe problems in performance. At a given fan speed, the pressure rise imposed on the single fan becomes excessive. This significantly decreases air flow rate and causes the fan to operate in a severely off-design condition. The single fan might be forced into a stalled flow condition leading to very low efficiency and significantly increased noise levels. For these reasons, parallel operation of the fans is preferred.

In order to increase the size or diameter of fans 70 and 72, the fan plane, instead of being horizontal, is bent at the mid-point of the dimension 18 to provide a predetermined angle 100 (see FIG. 2) with the horizontal. When the tube core utilizes the inverted V configuration, the predetermined angle is preferably about 30° below the horizontal, with this angle forming a first fan plane 102 on which fan 70 is mounted, i.e., the axis of the motor shaft driving fan 70 is oriented perpendicular to plane 102, and a second fan plane 104, on which fan 72 is mounted. These two fan planes intersect one another, forming an obtuse angle of about 120°. If the two halves of the tube core use a V configuration, the predetermined angle would be about 30° above the horizontal. In other words, the bent fan plane is oriented to nest with the bent tube core portions.

In order to prevent recircuiting of air, in the event one fan should fail, fans 70 and 72 are isolated from one another by baffles 106 and 108 in the fan planes, which surround fans 70 and 72, respectively, and by a vertical baffle 110 which extends upwardly from the bend or intersection lines of the two fan planes.

Airfoil blading for the fans 70 and 72 is preferred over single-skin sheet metal fan blading. Fans which rotate at a nominal 600 rpm having a tip diameter of about 35 inches and a hub diameter of about 24 inches, and 16 airfoil blades having a tip solidity of 0.8, are suitable for fans 70 and 72. Further, an asymmetric, balanced 16 blade design is preferred. The asymmetric arrangement reduces the magnitude of the blade passing tones, i.e, a fundamental tone of 160 Hz for a 600 rpm speed, by shifting energy to higher frequencies in the spectrum. Reduction of the fundamental blade pass tones of up to 10 dB on a one-third octave band basis are typical for asymmetric blading.

Figure 4:
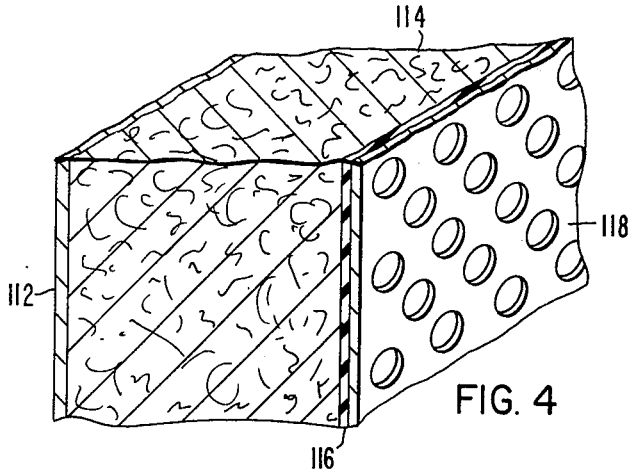
FIG. 4 is a fragmentary cross-sectional perspective view of acoustic treatment applied to the inner walls of the heat exchanger shown in FIG. 1.

Section 40 in addition to housing the heat exchanger core and fans, also operates as a reactive muffler. A reactive muffler produces an acoustical impedance mismatch for the sound energy travellng through it. This mismatch causes part of the sound energy to be reflected back toward the sound source, preventing if from being transmitted out of the muffler. A small amount of absorbing material placed within a reactive muffler yields significant sound absorption because of enhanced sound pressure caused by the reflection of the sound energy. A reactive muffler lined with absorbing material can produce a reduction of sound energy transmission greater than the sum of the attenuation and reflection effects considered separately. An example of a preferred acoustic treatment for the inner walls of the reactive portion 40 is shown in FIG. 4, which is a fragmentary perspective view, in section, of a wall of the reactive portion 40. The wall is indicated at 112 which is a metallic panel of suitable thickness to insure adequate transmission loss, such as 16 gauge steel. A three inch thick layer 114 of sound absorbing material, such as Owens Corning TIW type II fiber-glass, or equivalent, is attached to the wall portion. A 0.001 inch thick film 116 of plastic, such as the polyester sold under the trademark Mylar is preferably applied to the exposed face of the fiberglass, to prevent if from becoming clogged with dirt. A perforated or porous metallic facing 118 is preferably applied over the Mylar film to provide additional protection for the fiberglass. The porous facing should be in contact with the Mylar film, and the Mylar film should in turn be in contact with the sound absorbing material. When this is the case, there is a suitable mass reactance and resistance produced by the facing which leads to effective sound absorption. However, care should be taken that the sound absorbing material is not compressed to any degree beyond that established for the design, as it will reduce its sound absorbing characteristics. The porous facing will be described in greater detail when describing the dissipative muffler sections 38 and 42 of the cooler 10.

The dissipative muffler sections 38 and 42 may be of like construction, and thus only muffler section 38 will be described in detail. Any device placed in an air duct whose purpose is to reduce the sound power transmitted through the device by adsorption of the sound is termed a dissipative muffler. Such devices generally have relatively high attentuation characteristics over a wide frequency range. Thus, they are well suited to control applications with sources, such as fans, which produce a broadband noise spectrum. The attenuation of the dissipative muffler section cannot be optimized for all frequencies utilizing one specific absorptive material. For cooler 10, relatively high values of attentuation in the 125 Hz to the 1000 Hz range are essential. The variation of attenuation with flow resistivity, which is a function of material density and fiber diameter, of different absorptive materials at 125 Hz indicates that TIW type II fiberglass, which was hereinbefore referred to, is the best compromise to obtain large low frequency attenuation for the muffler configuration to be described. TIW type II fiberglass, is an unbonded fiberglass, which should not degrade in shape retention with temperature.

Basically, dissipative muffler section 38 includes a plurality of upstanding baffle numbers 120 disposed in spaced side-by-side relation. The pressure drop increases exponentially as the percent of the air flow area blocked by the baffles 120 increases, while the acoustic attenuation increases essentially linearly. Thus, a relatively small flow blockage, i.e., large percentage open area, is necessary in order to obtain a small pressure drop. In addition, the low frequency attenuation of the dissipative muffler increases as the baffle spacing increases. However, at higher frequencies, the expected attenuation decreases with increasing baffle spacing because the sound waves "beam" through the muffler passages without being absorbed, i.e., the wavelength is less than the baffle spacing. The actual spacing of the baffles is determined by the noise spectrum of the selected fan. The "beaming" of high frequency sound waves, combined with the likely presence of transverse modes, limits the high frequency performance of the baffles.

Figure 5:
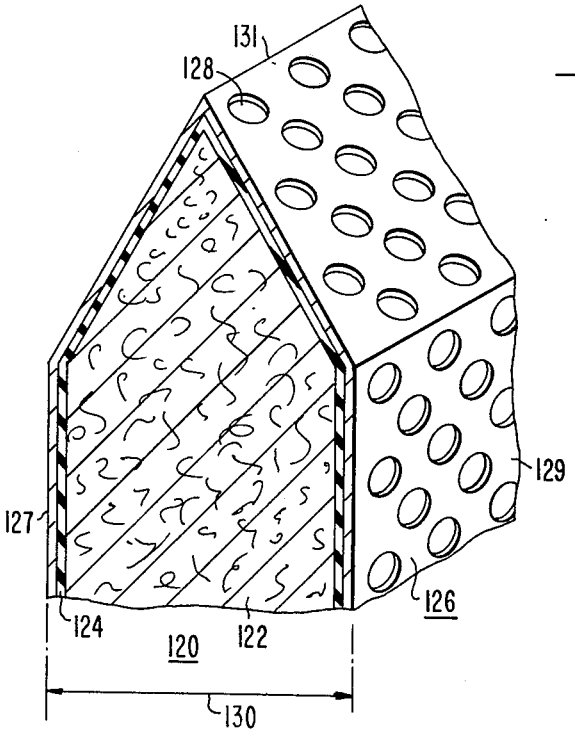
FIG. 5 is a fragmentary cross-sectional perspective view of a baffle used in a sound dissipating muffler shown in FIG. 1.

FIG. 5 is a fragmentary, perspective view of a preferred construction for each of the baffles 120. The TIW type II fiberglass 122 is covered with Mylar film 124. Mylar film is basically transparent to sound, but it does provide additional attenuation in the low frequency range. A porous metallic facing 126 provides an outside shell and the necessary rigidity for supporting the fiberglass 122. The outside shell 126 defines first and second major parallel flat surfaces 127 and 129, respectively, which preferably terminate in a V-shaped, or otherwise smooth configuration at the upper end 131 of the baffle, and a rounded or U-shaped configuration at the bottom end 133 (shown in FIG. 1), to minimize the pressure drop of the air flowing over the baffle. A 30% open area for the porous facing material 126 is suitable in preventing the facing material from adversely affecting the attenuation of the absorptive material. For example, openings 128 having a diameter of 3/16 inch, with the openings being on staggered 5/16 inch centers, has been found to be suitable. The material 126 may be 20 gauge sheet metal, for example, suitably treated to prevent corrosion.

The pressure drop through the dissipative muffler 38 is most significant. If the pressure drop is excessively high, the additional pressure delivery by the fans would reduce the fan performance and increase the fan noise level. A suitable dissipative muffler arrangement for the exemplary embodiment, designed for a low pressure drop and acceptable muffler length, includes a baffle width dimension 130 of about 4 inches, and a spacing between the vertical flat adjacent surfaces of neighboring baffles of about 6.5 inches, which produces eight open channels or spaces and a muffler length in the vertical direction of 3.5 feet. This provides a pressure drop of 0.041 inches of water. It should be noted that the baffles 120 are oriented such that the open channels between the spaced baffle members extends between sides 22 and 24. This orientation reduces the inlet and outlet plenum section air flow restriction and improves inlet and outlet air flow distribution, compared with orienting the baffles such that the channels extend between sides 26 and 28 of housing 16.

While dissipative muffler baffles 120 may be extended to the "floor" and "ceiling" of the cooler, the resulting elimination of the inlet and outlet plenum volume offset any gains due to the use of larger baffles. Also, the extended baffles would produce a higher pressure drop, they would utilize more material, and they would be more difficult to manufacture. Thus, the baffle configuration and arrangement shown in FIG. 1 is preferred.

To reduce the amount of high frequency sound which might beam through the mufflers, a partial center divider 132 is incorporated, which is disposed perpendicular to and between the muffler baffles 120.

The performance of the dissipative muffler is increased by lining the muffler duct end walls perpendicular to the baffles 120, and the partial center divider 132, with a three inch layer of TIW type II fiberglass, Mylar film, and a porous metal facing. Additional attenuation may be obtained by lining the remaining walls of the muffler in the same manner.

The air inlet portion 36 has 90° curved bends 134 and 136 which smoothly change the horizontal air flow entering the housing 16 to a vertical air flow. The 90° bends are lined with absorptive material, such as the hereinbefore mentioned TIW type II fiberglass, wrapped with Mylar and protected with a porous metallic facing. In like manner, the air outlet portion 44 has 90° curved bends 138 and 140 lined with absorptive material. The 90° bends and absorptive lining on both ends of housing 16 are very important to the invention as they intercept high frequency sound which beams through the dissipative muffler passages. The attenuation of the lined bends depends primarily on the thickness of the absorptive lining material. A thickness of about 4 inches is adequate for most sound absorbing materials which are suitable for attenuation of frequencies above 1000 Hz. The hereinbefore mentioned TIW type II fiberglass may be used.

The inlet and outlet openings are preferably dimensioned to be approximately one-half the free cross-sectional area of the cooler 10. This causes the air flow to slow up when leaving the dissipative muffler and then to speed up slightly when exiting through the louvered areas. This change in flow areas makes the inlet and exhaust regions act as small, lined, reactive plenum chambers without significantly increasing the system air pressure drop. The louvers 74 and 76 in the inlet and exhaust regions 46 and 44, respectively, serve primarily to guide the air flow and to minimize the entrance of rain into the cooler 10. They also contribute a small amount to the overall noise attenuation. The effect of the louvers on the attenuation occurs primarily at frequencies above 2 kHz.

In summary, there has been disclosed a new and improved FOA cooler for continuously cooling the fluid coolant of large electrical apparatus, such as an electrical power transformer. The cooler maximizes the heat dissipative capacity for given base area, while reducing operating noise level substantially below similarly rated prior art FOA coolers, by arranging the major components of the cooler in a vertical relationship. By both slanting and bending the finned tubes of heat exchanger, and by slanting and bending the fan plane, the heat transfer section of the cooler can be sized to fit inside a relative small base area and still occupy a moderate height. In the specific example, the overall cooler height was reduced by 2.5 feet by bending the heat exchanger at the mid-points of the tube lengths. The sound power flow from the fans is the major noise source. Splitting the heat exchanger into lower and upper units, and locating the fans between them, as in the preferred embodiment of the invention, provides additional acoustic isolation. This split configuration has the advantage of tending to isolate source noise in a central cavity. Such configuration also provides more latitude in fluid circuiting arrangements. The complete enclosure about the fans also provides excellent personnel safety. The cooler core and fans are also protected from accidental damage and vandalism, due to the shroud type of enclosing. Acoustic absorption materials, both above and below the heat transfer section of the cooler further reduce sound levels outside of the coller without exceeding normal height constraint. Ninety-degree curved bends at the inlet and outlet ports lined with absorptive material add high frequency sound attenuation. Additionally, by ingesting air at the bottom of the cooler and discharging it at the top minimizes the amount of air mixing and recirculating outside of the heat exchanger 10. Room is available in the cooler 10 for locating the oil pump in an acoustically isolated compartment, preferably at the bottom of the cooler.

We claim as our invention:

1. A fluid-to-air heat exchanger for cooling electrical power apparatus, comprising:

a vertically elongated housing having side wall, top and bottom portions, and air openings near the top and bottom portions, a fluid-to-air tube core in said housing, said tube core having inlet and outlet means adapted for fluid flow communication with the electrical apparatus to be cooled, said tube core being vertically divided into upper and lower portions having a predetermined spacing therebetween, air moving means in said housing, in the spacing between the upper and lower portions of the tube core and operative for moving air vertically in a predetermined direction through the lower and upper portions of said tube core, with the air entering and exiting predetermined openings in said housing, and sound dissipative muffler means in said housing, above the upper portion of said tube core and below the lower portion of said tube core, for dissipating sound energy associated with the air being vertically moved through the housing.

2. The heat exchanger of claim 1 wherein the housing is free standing on a rectangularly configured base defining short and long sides, and wherein the air openings are disposed in the long sides, and the inlet and outlet means for fluid flow communication with the electrical apparatus to be cooled are located on a common long side.

3. The heat exchanger of claim 1 wherein the first and second fans each include an electric motor, motor shaft, and fan blades, with the first and second fans being mounted side-by-side and oriented such that an imaginary plane passing through each fan perpendicular to the axis of the motor shaft intersects to form an obtuse angle of about 120°.

4. The heat exchanger of claim 1 wherein the upper and lower portions of the tube core are each constructed of a plurality of finned tubes arranged in vertical layers, with a predetermined number of finned tubes per layer.

5. The heat exchanger of claim 1 wherein the fluid inlet means is connected to the upper portion of the tube core, and the fluid outlet means is connected to the lower portion of the tube core, with the fluid flow being from the upper portion to the lower portion, and wherein the predetermined direction of air flow in the housing responsive to the air moving means is vertically upward.

6. The heat exchanger of claim 1 wherein the upper and lower portions of the tube core include first and second horizontally spaced headers and a plurality of finned tubes, with each of the finned tubes being bent at substantially its mid-point such that the upper and lower portions each have a V configuration in a predetermined orientation, wherein each tube extends outwardly from a first header at a predetermined angle from the horizontal until reaching its mid-point and then extends to the associated second header at a predetermined angle from the horizontal.

7. The heat exchanger of claim 1 wherein the air moving means includes two fans operating in parallel disposed on an imaginary plane which is bent to provide an obtuse angle of about 120°, with the fans being disposed on the two legs of the bent plane, and the upper and lower portions of the tube core are each bent to define a substantially V-shaped configuration, with the bent fan plane and the bends in the upper and lower portions of the tube core being similarly oriented in a nested arrangement.

8. The heat exchanger of claim 1 wherein the housing has a rectangular configuration in horizontal cross-section, having first and second long sides and first and second shorter sides, and including air inlet and outlet portions at the bottom and top portions of the housing, respectively, with the air openings being disposed in the first and second long sides of the inlet and outlet portions, said inlet portion having curved sound absorbing 90° bend portions which smoothly change the direction of air which enters the inlet portions from the horizontal to the vertical, said outlet portions having curved sound absorbing 90° bend portions which smoothly change the direction of the air from the vertical to the horizontal for egress through the outlet portions, and which intercepts high frequency sound which may beam through the sound dissipative muffler means.

9. The heat exchanger of claim 1 wherein the upper and lower portions of the tube core each include first and second headers horizontally spaced, and a plurality of finned tubes which extend between the first and second headers, with the fluid flow in the tubes between said first and second headers being in parallel.

10. The heat exchanger of claim 9 wherein the inlet and outlet means are associated with the first headers of the upper and lower tube portions, respectively, with the fluid flow entering the first header of the upper tube portion, flowing in parallel through the finned tubes to the second header of the upper portion, to the second header of the lower tube core, through the finned tubes of the lower core to the first header of the lower tube core in parallel, and then to the outlet means.

11. The heat exchanger of claim 1 wherein the air moving means includes the first and second fans operating in parallel.

12. The heat exchanger of claim 11 wherein the first and second fans are axial fans.

13. The heat exchanger of claim 11 wherein the first and second fans are axial fans having a plurality of asymmetrically disposed blades which shift the sound energy to higher frequencies.

14. The heat exchanger of claim 11 including means isolating the parallel air flow paths associated with the first and second fans to prevent recircuiting of the air in the event of failure of one of the fans.

15. The heat exchanger of claim 1 wherein the sound dissipative muffler means includes a plurality of baffles, with each of said baffles having first and second major flat parallel vertically oriented surfaces, said plurality of baffles being disposed in side-by-side relation with a predetermined spacing between adjacent flat surfaces, to define a plurality of sound absorbing channels.

16. The heat exchanger of claim 15 wherein each baffle includes a perforated rigid shell which includes portions defining the flat parallel surfaces, a fiberglass core disposed within the shell, and a thin plastic film between the shell and fiberglass core.

17. The heat exchanger of claim 15 wherein each of the baffles is about four inches wide measured between the first and second flat parallel surfaces, and the predetermined spacing between adjacent baffles is about 6.5 inches.

18. The heat exchanger of claim 17 wherein the housing is rectangularly configured in horizontal cross-section defining two short sides and two long sides, with the air openings being disposed in the two long sides and wherein the first and second flat major surfaces of the baffles are oriented perpendicular to said long sides.

19. A fluid-to-air heat exchanger for cooling electrical power apparatus, comprising:

a vertically elongated housing having side wall, top and bottom portions, said housing having a predetermined cross-sectional configuration defining first and second parallel sides and third and fourth parallel sides, said housing having air openings in the first and second sides with certain openings being located near the bottom portion for receiving outside air and certain openings being located near the top portion for exhausting air, a fluid-to-air tube core in said housing, said tube core having inlet and outlet means adapted for fluid flow communication with the electrical apparatus to be cooled, said tube core including a plurality of finned tubes vertically divided into upper and lower sections, air moving means in said housing, in the space between the upper and lower sections of said tube core, and operative for moving air vertically upward through said housing and tube core, sound dissipative muffler means in said housing, above said tube core and air moving means, and below said tube core and air moving means, and sound absorption means defining 90° bends adjacent the openings in the housing.

20. The heat exchanger of claim 19 wherein the plurality of finned tubes are bent at their mid-points to define a predetermined angle, and oriented to extend between the third and fourth sides.

21. The heat exchanger of claim 19 wherein the air moving means includes first and second fans operating in parallel.

22. The heat exchanger of claim 21 wherein the finned tubes are bent at their mid-points and oriented to define a V configuration having a predetermined orientation, and the first and second fans are each disposed on a fan plane oriented at a predetermined angle with the horizontal, with said fan planes intersecting to define an obtuse angle.

23. A fluid-to-air heat exchanger for cooling the fluid of electrical power apparatus, comprising:

a vertically elongated housing having top, bottom and side portions, said housing having a rectangular configuration in horizontal cross-section, including first and second long sides, and first and second shorter sides, said housing defining air openings on the first and second long sides, adjacent to the bottom portion for admitting air, and adjacent to the top portion for expelling air, sound absorbing means defining curved 90° bends adjacent to the air openings for absorbing sound energy and for smoothly changing the direction of air between horizontal and vertical directions, a fluid-to-air finned tube core in said housing, said tube core being vertically divided into upper and lower portions to define a predetermined space therebetween, each of said upper and lower portions including first and second headers and a plurality of finned tubes which extend therebetween, said plurality of finned tubes each being bent to define a predetermined angle at its mid-point, said upper and lower portions being similarly oriented such that the bent finned tubes define nested V configurations having a predetermined orientation which extends between the first and second shorter sides of the housing, a pump in the bottom portion of said housing, piping means for interconnecting said upper and lower portions of the tube core and said pump including inlet means connected to the first header of the upper portion for receiving fluid from the electrical apparatus to be cooled, interconnecting means between the second headers of the upper and lower portions, interconnecting means between said first header of the lower portion and said pump, and outlet means on said pump for returning fluid to the electrical apparatus to be cooled, to cause parallel fluid flow between the headers of the upper portion, and parallel fluid flow between the headers of the lower portion, first and second axial fans disposed side-by-side in the space between the upper and lower portions of the tube core, one each over a leg portion of the V configuration of said upper and lower portions, said fans each having an electrical motor, shaft and airfoil fan blades, operative to move air vertically upward through the housing, said shaft of the fan motors being tilted from the vertical such that their fan planes intersect to define a V configuration which nests between the V configurations of the upper and lower portions of the tube core, to enable larger diameter fans to be accommodated and reduce the height dimension of the tube core, and including isolating means between the fans to prevent air recircuiting in the event of failure of one of the fans, and first and second sound dissipative muffler means in the housing, each including a plurality of spaced, upstanding baffle members, said first sound dissipative muffler means being disposed between the sound absorbing means which define the 90° bends at the bottom portion of the housing and the lower portion of the tube core, with the baffle members being oriented such that the space between them extends between the first and second long sides of the housing, said second sound dissipative muffler means being disposed between the sound absorbing means which defines the 90° bends at the top portion of the housing and the upper portion of the tube core, with the baffle members being oriented such that the space between them extends between the first and second long sides of the housing, and including sound absorbing means on at least certain of the inner walls of the housing.

24. The heat exchanger of claim 23 wherein the baffle members have a width of about 4 inches, and the spacing between adjacent baffle members is in the range of six to seven inches.

25. The heat exchanger of claim 23 wherein the upper and lower portions of the tube core each have five vertically nested layers of finned tubes, with about 35 to 40 finned tubes per layer.

* * * * *